US005987700A

United States Patent [19]

Edlund

[11] Patent Number: 5,987,700

[45] Date of Patent: Nov. 23, 1999

[54] CLEANING TOOL OF A VACUUM CLEANER

[76] Inventor: Göran Edlund, Holmbäcksvägen 17, S-892 34 Domsjö , Sweden

[21] Appl. No.: 08/945,697

[22] PCT Filed: May 7, 1996

[86] PCT No.: PCT/SE96/00594

§ 371 Date: Mar. 11, 1998

§ 102(e) Date: Mar. 11, 1998

[87] PCT Pub. No.: WO96/37142

PCT Pub. Date: Nov. 28, 1996

[30] Foreign Application Priority Data

May 21, 1995 [SE] Sweden ..... 9501912

[51] Int. Cl.[6] ..... A47L 9/06

[52] U.S. Cl. ..... 15/420; 15/421

[58] Field of Search ..... 15/415.1, 420, 15/421

[56] References Cited

U.S. PATENT DOCUMENTS

| | | | |
|---|---|---|---|
| 2,164,392 | 7/1939 | Ellis | 15/420 X |
| 2,296,462 | 9/1942 | Betts . | |
| 2,348,082 | 5/1944 | Lofgren | 15/421 |
| 2,581,002 | 1/1952 | Creswell . | |
| 2,624,063 | 1/1953 | Van Der Heem . | |
| 2,934,780 | 5/1960 | Taplin | 15/420 X |
| 3,238,557 | 3/1966 | Foster | 15/421 X |
| 3,550,183 | 12/1970 | Wolf | 15/420 |
| 3,952,362 | 4/1976 | Torii | 15/421 X |
| 4,677,705 | 7/1987 | Schuster | 15/420 X |
| 5,123,141 | 6/1992 | Erickson et al. . | |

FOREIGN PATENT DOCUMENTS 227964 10/1943 Sweden .

*Primary Examiner*—Chris K. Moore
*Attorney, Agent, or Firm*—Pillsbury Madison & Sutro LLP

[57] ABSTRACT

This invention relates to a suction nozzle for connection to a hose, which is under vacuum and which is connected to a vacuum cleaner, the nozzle having a topside and an underside. According to the invention the suction nozzle is characterized by the combination of the following features: the nozzle has two suction holes (7, 8), which debouch on the underside (3) of the nozzle (1), and each of which is connected to a pipe part (5, 6), which parts are stationarily arranged on the topside (2) of the nozzle; the two pipe parts (5, 6) are connected with a T-formed connection pipe (4), which in its turn is connected with the pipe being under vacuum, the pipe being under vacuum being pivotally essentially 180° in relation to the nozzle; the underside (3) of the nozzle (1) is designed with two separate vacuum chambers (13, 14), the one suction hole (7) debouching into the one vacuum chamber (13), whereas the other suction hole (8) debouches into the other vacuum chamber (14).

9 Claims, 1 Drawing Sheet

CLEANING TOOL OF A VACUUM CLEANER

This application is the national phase of international application PST/SE96/00594, filed May 7, 1996 which designated the U.S.

This invention relates to a suction nozzle for attachment to a vacuum cleaner hose having a topside and an underside.

BACKGROUND OF THE INVENTION

Throughout the years that vacuum cleaners have been on the market, a great number of vacuum cleaner nozzles have been developed for use mostly in private homes. Conventional nozzles are connected to a hose (in most cases a folded and stiffened hose) under vacuum by means of a slightly conical coupling which principally comprises a female and a male part. That part of the nozzle which is in contact with the floor is usually provided with bristles. These bristles are nowadays made of synthetical materials. The underpart of the nozzles usually also have a slide surface comprising a hard surface. This slide surface is usually made of steel. More recently, it has been more and more common to make slide surfaces out of a plastic material. In order to get a maximum suction effect and in order to minimize the friction against different floors, the nozzles are designed in such a way that it is possible to change the type of contact surface against the floor. When vacuum cleaning, for instance, hard floors, the nozzles are adjusted so that its bristle part is in contact with the floor. When vacuum cleaning soft floors, like for instance wall-to-wall carpets, the bristle part is raised so that the slide surface will instead be in contact with the floor.

The vacuum cleaner nozzles in the market today have several drawbacks. In the following, some of these drawbacks shall be mentioned. It is well known that after using the nozzles for a time, the bristles become covered by dirt. This results in a tightening of the space between the bristles, which results in deteriorated suction effect. Furthermore, the concentration of dust on the bristles results in a hygenical inconvenience and constitutes a good growth environment for bacteria. This circumstance may cause allergic attacks. Moreover, dirty bristles are very hard to clean. If the cleaning is successful, the final result in those cases is deteriorated qualities of the bristles.

Another drawback is that when vacuum cleaning different floors, the vacuum cleaner nozzles there has to be made an adjustment between the bristle part and the slide surface of the nozzle. Since this means a more complicated construction, the risk increases that as time goes on there will be problems with the device. The complicated construction also means that the manufacture of the vacuum cleaner nozzle is made more expensive.

A further drawback with conventional vacuum cleaner nozzles is that the relatively complicated construction leads to leakage at the coupling between the nozzle and the pipe connection. There will also be a leakage at the change device of the nozzle for the adjustment between the bristle and the slide surface.

A further drawback with conventional vacuum cleaner nozzles is the fact that they do not effectively suck up rubbish positioned close to the edging of a room. Thus, it is practically impossible by means of conventional nozzles to suck up rubbish close to the floor borders. Moreover, most nozzles are rather clumsy and relatively high (rather big in a vertical direction), which makes it difficult or even impossible to reach positions under low spaces with the nozzle.

The present invention reduces or even eliminates the problems with existing vacuum cleaner nozzles. The invention comprises a new vacuum cleaner nozzle which shall be described in the following. According to the invention, the lower part of the nozzle is separated into at least two separate vacuum chambers. A feature of the vacuum chambers of the present invention is that they are provided with underpressure (vacuum) via pipe parts, each of which being connected to one vacuum chamber. Furthermore, the invention is characterized by the fact that its underpart being in contact with the floor is exchangeable and that this exchangeable underpart is suitable to both hard and soft floors. A further characterizing feature of the invention is that the one side of the long side of the nozzle is provided with recesses, which function as air channels when the nozzle is in contact with for instance a vertical wall surface.

In the following, the invention will be described in more detail with reference being made to the accompanying drawings which illustrate, by way of example, the principles of the invention.

DETAILED DESCRIPTION OF THE PREFERRED EMBODIMENT ILLUSTRATED IN THE DRAWINGS

Figure 1:
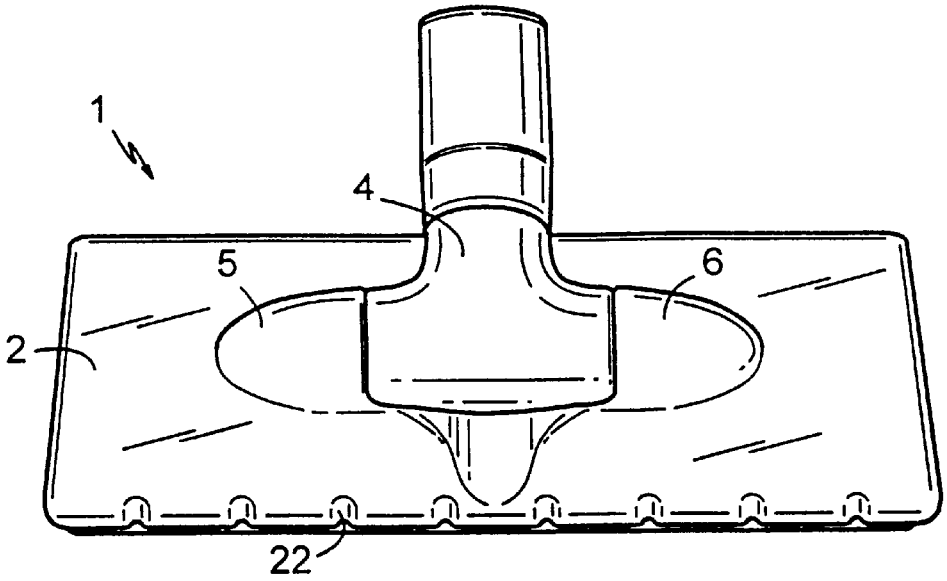
FIG. 1 is a perspective view of an embodiment of the new vacuum cleaner nozzle, seen obliquely from above.
Figure 2:
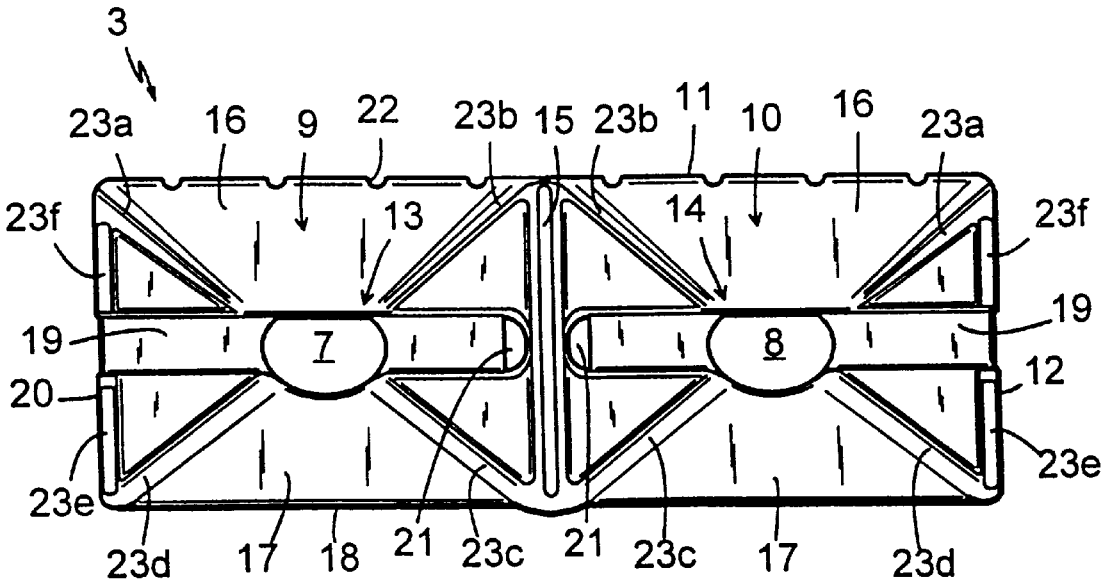
FIG. 2 is a view from below the nozzle according to the embodiment shown in FIG. 1.

Referring to FIGS. 1 and 2, there is shown a new vacuum cleaner nozzle 1, which is intended to be connected to a hose, which is under vacuum, and which in its turn is connected to a vacuum cleaner. The nozzle has a topside 2 and an underside 3. The topside 2 of the nozzle 1 has a centrally positioned, T-designed connection pipe 4, which partly is intended to be connected with the hose under vacuum, partly is pivotally connected to two pipe parts 5, 6, which are fixed on the topside of the nozzle and are arranged on each side of the transverse center line of the nozzle 1. Each of these pipe parts 5, 6 is in connection with the underside 3 of the nozzle 1 via suction hole 7, 8, which holes accordingly also are positioned on each side of the transverse centre line of the nozzle and are suitably arranged at the centre of respective portion 9, 10 on each side of the transverse midline of the underside 3. The vacuum is led to the underside of the nozzle via the two holes 7, 8.

The nozzle can be manufactured from different material. When manufacturing in great volumes, the nozzle is preferably made from plastic material, which can be recovered without detrimental influence on the environment. Other recoverable materials like steel and aluminum can also be used. Also, mixtures of these materials or composites of these or other materials can be used.

The nozzle 1 has an essentially rectangular form and its long side 11 with respect to length is comparable with nozzles that are in the market today. However, the construction makes it possible to essentially increase its long side with maintained suction effect. Thus, it is within the scope of the invention to be able to manufacture nozzles, the length of the long side of which is redoubled compared with known nozzles, for use in private homes. This means that the nozzle can have a long side reaching 600 mm. Also its short side 12 is mainly of the same dimension and may even be made broader than what is usual for conventional vacuum cleaner nozzles. A broader nozzle gives a more stable contact against the floor. Surprisingly, the broader nozzle is not negatively influenced by friction. The height of the nozzle can vary from 8 mm up to 60 mm.

The two suction holes 7, 8, which transfer an underpressure (vacuum) to the underside 3 of the vacuum cleaner nozzle 1 are separated from each other by the special design of the underside 3. Thus, the underside has such a design that it forms two separate vacuum chambers 13, 14, which are separated by a separating bar 15, which is arranged at the transverse center line of the underside and is parallel with this line. This separating bar 15 is intended to rest against the floor during vacuum cleaning.

Each vacuum chamber 13, 14 comprises recesses, which are made in the underside 3 of the vacuum cleaner nozzle 1 and which are intended to be under vacuum so that dust and rubbish can be sucked in under the nozzle via the mentioned recesses and further via the holes 7, 8 towards the vacuum cleaning apparatus itself.

The recesses of each chamber 13, 14, according to this embodiment, comprise two V-formed recesses 16, 17, the point of the V beginning at the centre of the holes 7, 8 and diverges out towards respective longside 11, 18. Furthermore, each chamber 13, 14 has an essentially rectangular recess 19, which extends centrally in the nozzle essentially parallel with its longitudinal direction from the shortside 12, 20 of the nozzle up to the transverse separating bar 15. At this separating bar each rectangular recess 19 is provided with a hole 21, which has a connection with the surrounding atmosphere on the topside of the vacuum cleaner nozzle 1. The underside 3 of the nozzle is supplied with air so that the vacuum cleaner nozzle will not easily adhere to a floor and can be moved over, for instance, wall-to-wall carpets.

The longitudinal front surface of the nozzle is, according to the present invention, provided with recesses 22 in order that the air supply shall be improved when vacuum cleaning against vertical walls and the like. In those cases when the nozzle is provide with a shock absorbing front edge, the mentioned recesses are suitably made in this front edge.

In order that the vacuum cleaner nozzle shall easily slide on the floor during vacuum cleaning, portions on the underside of the nozzle, which, in each chamber 13, 14are closest to the floor, are designed with projecting ridges 23*a–f*. Projecting ridges 23*a–f* are on essentially the same level as the separating bar 15, and accordingly are intended to slide on the floor.

Those portions on the underside 3 of the nozzle which have a direction perpendicular to the longitudinal direction of the nozzle and which are intended to be in contact with the floor during vacuum cleaning, details 15 and 23*e* and *f*, are provided with a feltlike material, which in addition to other things constitutes protection for the floors. This feltlike material is a frictional element and is placed in such a way that there will be a certain distance between the nozzle and the floor that shall be vacuum cleaned. A suitable distance between the nozzle and floor varies between 0.5 mm to 5 mm and is preferably between 0.8 mm and 1.3 mm. The frictional element may be manufactured of different materials, like for instance synthetical fibres (nylon), viscose fibres, plush and velvet. The choice of material is determined among other things by the friction against the floor that is desirable. Within the scope of the invention it is possible to exchange the frictional element without changing any other part of the vacuum cleaner nozzle. Thus, the frictional element can be mounted on small rails (not shown in FIG. 2) which in turn can be brought into notches cut out in the plate. Of course it is also possible for instance to fasten the frictional element by gluing.

A further advantage with the nozzle according to the invention is its fastening to the pipe being under vacuum. As has been mentioned previously the means, that shall be fastened to the pipe being under vacuum, comprises the connecting pipe 4, which is pivotally mounted essentially 180° in relation to the two pipe parts 5, 6. This arrangement makes it possible for the pipe being under vacuum to be able to be pivoted 180° in relation to the nozzle, which leads to a more effective handling during vacuum cleaning.

Demonstration Example

In order to test the invention simple experimentations were carried out. Thus, a very hard and smooth laminate floor, a floor coated with PVC (polyvinylcloride), a floor with a felt mat (short straws) and a floor with so called wall-to-wall carpet (long straws) were vacuum cleaned. In other words typical floor coatings were tested. The floors were littered with different kinds of rubbish including screened gravel having a defined size of 2.5 mm. Seven people were selected to form a test panel. In order not to influence the judgement of the test panel, the nozzles were covered by a specially manufactured cap. The nozzle according to the invention was compared with three of the most usual nozzles in the market.

The test panel favored the nozzle according to the present invention. Particularly surprising was the fact that the nozzle was so easy to convey over all floor coatings. This surprising effect was particularly remarkable since no change of the nozzle was required, i.e. independent of surface coating, the nozzle could convey with a better result than with the remaining nozzles without having to change the nozzle. This was entirely impossible to do with conventional nozzles without first changing their adjustment. This surprising effect may depend on the fact that when using the new nozzle there seems to arise an air cushion between the nozzle and the floor. An advantage that was recognized with the nozzle according to the invention was that it was easy also to vacuum clean ceilings lists and pipe lines.

In order to more objectively test the suction ability the screened gravel grains were laid out on top of a tape which was fastened on the laminate floor by gluing. Then the nozzles were conveyed slowly against the gravel grains. The distance to the grains at that moment when these ones were sucked up was noted as well as the relative suction ability of the nozzle. The nozzle according to the invention was received the relative suction ability of the FIG. 100%. The results are shown in the following table.

TABLE

| | Distance to Suction, mm | Relative suction ability % |
|---|---|---|
| Nozzle A | 8 | 67 |
| Nozzle B | 6 | 50 |
| Nozzle C | 10 | 83 |
| Nozzle according to the present invention | 12 | 100 |

As is seen, a considerably better result was received with the nozzle designed in accordance to the present invention than with the conventional nozzles. Thus, it could be observed that all experimentations turned out in favour of the nozzle according to the present invention.

The demonstration example illustrates several advantages achieved with the nozzle designed in accordance with the present invention. There are further advantages. The simplicity of the nozzle makes it relatively light and relatively inexpensive to manufacture. Thus, only two moulding tools are required if the nozzle is manufactured of plastic material. This is extremely favourable, since it is very expensive to manufacture moulding tolls with a high precision. Something that further reduces the manufacturing costs of the nozzle is its low weight, that partly reduces the expenses for the moulding tool and above all reduces the price in serial production of the nozzles. A further advantage is that it is possible to exchange the underpart of the nozzle 1, which from a sanitary point of view is very advantageous, since allergies are becoming more common.

An extremely useful advantage is the fact that no adjustment of the nozzle is required when vacuum cleaning different floors. Furthermore, the nozzle has an advantage in that it has an exceptional good ability to reach areas in narrow (low) spaces.

According to a preferred embodiment, the topside 2 and the underside 3, respectively, of the vacuum cleaner nozzle 1are made of two separate details, which are put together to a unit in a suitable way, for instance by means of locking with a snap-on procedure.

The invention is of course not limited to the shown and described embodiment but can be modified within the scope of the following claims. Thus, the production of the nozzle could for instance be made in such a way that it is manufactured as a single unit.

I claim:

1. A suction nozzle for connection to a hose attached to a vacuum cleaner, comprising:

a nozzle member having a topside, an underside, a front surface, and at least two suction openings, the at least two suction openings being connected to a pipe part arranged on the top side of the nozzle member and opening up to the underside of the nozzle member, wherein the underside of the nozzle member defines two vacuum chambers wherein a first of the at least two suction openings opens up to one of the two vacuum chambers, and wherein a second of the at least two suction openings opens up into another one of the two vacuum chambers, wherein the two vacuum chambers are separated by a separating bar element arranged on the underside of the nozzle member along a center line transverse to a longitudinal axis of the nozzle member, each of said two vacuum chambers defining an elongated recess on the underside of the nozzle member extending in the longitudinal direction of the nozzle member and being in connection with the surrounding atmosphere for supplying air to the underside of the nozzle member, each of the at least two suction openings opening into one of said recesses, and wherein the underside of the nozzle member is connected to the surrounding atmosphere on the topside by means of a hole formed on each side of the separating bar element in order to further improve the air supply.

2. A suction nozzle according to claim 1, wherein the nozzle member is provided with recesses formed along the front surface of the nozzle member extending through the topside of the nozzle member to the underside of the nozzle member for increased air supply.

3. A suction nozzle according to claim 1, wherein the pipe part is pivotally mounted to the topside of the nozzle member.

4. A suction nozzle according to claim 1 or 2, wherein the nozzle member has two long sides and two short sides defining a rectangular shape, the at least two suction openings respectively being centrally positioned in each of the two vacuum chambers, each of the two vacuum chambers having a V shaped recess, the point of the V beginning at the center of the at least two suction openings and diverging outwards towards the respective long side, and the elongated recess of each vacuum chamber extending from the short side of the nozzle member to the transverse separating bar element.

5. A suction nozzle according to claim 4, further comprising a frictional element attached to a projecting portion on the underside of the nozzle member, wherein said frictional element is interchangeable, and wherein the projecting portion is in contact with a floor during vacuum cleaning and extends in a direction substantially perpendicular to the longitudinal direction of the nozzle member.

6. A suction nozzle according to claim 4, wherein the top side and the underside of the nozzle member are formed as two separate components attached together, and wherein the underside component is an interchangeable component.

7. A suction nozzle according to claim 1 or 2, further comprising a frictional element attached to a projecting portion on the underside of the nozzle member, wherein said frictional element is interchangeable, and wherein the projecting portion is in contact with a floor during vacuum cleaning and extends in a direction substantially perpendicular to the longitudinal direction of the nozzle member.

8. A suction nozzle according to claim 7, wherein the top side and the underside of the nozzle member are formed as two separate components attached together, and wherein the underside component is an interchangeable component.

9. A suction nozzle according to any one of claims 1, 2, or 5, wherein the top side and the underside of the nozzle member are formed as two separate components attached together, and wherein the underside component is an interchangeable component.

* * * * *